US007091907B2

(12) United States Patent
Brachat

(10) Patent No.: US 7,091,907 B2
(45) Date of Patent: Aug. 15, 2006

(54) REACTIVE COUPLING ANTENNA COMPRISING TWO RADIATING ELEMENTS

(75) Inventor: Patrice Brachat, Nice (FR)
(73) Assignee: France Telecom, Paris (FR)

( * ) Notice: Subject to any disclaimer, the term of this patent is extended or adjusted under 35 U.S.C. 154(b) by 0 days.

(21) Appl. No.: 10/483,346

(22) PCT Filed: Jul. 11, 2002

(86) PCT No.: PCT/FR02/02448

§ 371 (c)(1),
(2), (4) Date: Jun. 15, 2004

(87) PCT Pub. No.: WO03/007423

PCT Pub. Date: Jan. 23, 2003

(65) Prior Publication Data

US 2004/0239565 A1 Dec. 2, 2004

(30) Foreign Application Priority Data

Jul. 11, 2001 (FR) ..... 01 09208

(51) Int. Cl.
*H01Q 1/38* (2006.01)

(52) U.S. Cl. ..... 343/700 MS; 343/853; 343/846

(58) Field of Classification Search ..... 343/700 MS, 343/829, 830, 846, 850, 853
See application file for complete search history.

(56) References Cited

U.S. PATENT DOCUMENTS

| | | | | |
|---|---|---|---|---|
| 5,043,738 | A * | 8/1991 | Shapiro et al. | 343/700 MS |
| 5,661,493 | A * | 8/1997 | Uher et al. | 343/700 MS |
| 6,054,953 | A | 4/2000 | Lindmark | 343/700 MS |
| 6,091,373 | A | 7/2000 | Raguenet | 343/700 MS |

FOREIGN PATENT DOCUMENTS

| | | |
|---|---|---|
| EP | 0605338 | 7/1994 |
| WO | WO 9966594 | 12/1999 |

* cited by examiner

*Primary Examiner*—Hoang V. Nguyen
(74) *Attorney, Agent, or Firm*—Blakely Sokoloff Taylor & Zafman

(57) ABSTRACT

The invention relates to a printed antenna comprising two planar radiating elements (25, 45) which are more or less stacked on top of each other. A first reactive coupling (5, 15) layout can excite one of the radiating elements (25, 45), said first reactive coupling layout comprising at least one feed line (6, 7) and a conductive ground plane (15) which is equipped with at least one coupling slot (16, 17). Moreover, the antenna comprises a second reactive coupling (25, 35) layout which can excite the other radiating element. The invention is characterised in that the radiating elements (25, 45) are provided with surface areas that are sufficiently similar so that the first reactive coupling layout produces a simultaneous coupling of the two radiating elements (25, 45).

13 Claims, 7 Drawing Sheets

REACTIVE COUPLING ANTENNA COMPRISING TWO RADIATING ELEMENTS

This application is a 371 of PCT/FR02/02448 of Jul. 11, 2002.

The invention relates to compact printed antennas, in particular elementary printed antennas employing plated technology for reception and/or transmission arrays, for example for the purpose of carriage on board a craft.

Forthcoming satellite-based multimedia services will necessitate simultaneous access to several services and to several satellites, thereby requiring steerable reception antennas which will eventually incorporate intelligence. The present ground-based technologies employing parabolic dishes and mechanical solutions will rapidly be restrictive in respect of mass access to these services on account of esthetics and lack of compactness.

The solution which will eventually come to the fore will be the multi-satellite flat antenna of active array type with electronic steering. In the frequency bands envisaged (Ku and beyond), such antennas do not yet exist essentially on account of cost and technology.

As far as printed technology is concerned, in the Ku band for example (reception 10.75–12.75 GHz) there is at present no broadband radiating element (over 30%) or dual-band radiating element (18% on reception and 4% on transmission) because of the small-band nature of the printed elements. Furthermore, the presence on the same structure of active transmission components (SSPA amps etc.) and of active reception components (LNA low noise receivers) poses a crucial problem of isolation between the transmit/receive ports so as to avoid the saturation of the reception stages.

Likewise, the problem of the losses generated in dielectric substrates or on conducting circuits is particularly crucial on reception because of the reduced noise temperature and a critical G/T ratio.

Lastly, the present cost of the integration of active elements is prohibitive at present for a mass-market application.

Conventionally, dual-band (2 port) printed antennas are produced using three technologies.

A first technology consists in the use of orthogonal modes on an asymmetric patch. This solution permits two separate ports for each band but it precludes dual-polarization operation (there is only one polarization per frequency).

A second technology consists in the use of multiple patches: various patches operating as so many resonators at different frequencies and height-wise stackable or distributed surface-wise. The latter solution being very restrictive in terms of compactness when the element is to be integrated into an array.

A third technology consists in the use of reactively loaded small plates or patches. The load can consist of in-line stubs loaded by microstrips or coaxials, by vertical short-circuit "studs" or else by the incorporation of slots, apertures or notches on the patches themselves.

The engineering of elements that are at one and the same time dual-band and dual-polarization (4 ports: two polarizations in each band) is much trickier (multilayer structure and incorporation of reactive loads by way of stubs, slots or short-circuit studs).

The solution proposed in document [3] uses coaxial lines to feed the element associated with one of the two bands.

This type of solution with vertical coaxial studs exhibits very significant assembly costs during the fabrication of an array antenna.

The solution of document [2] exhibits two levels of patches: a first level for the high band fed by coupling slots, which tucks the feed lines behind a ground plane. A second level of patch is used by the low band with a base element of large dimensions that has been perforated so as to allow the radiation of the lower patches to "pass through". This upper level is fed by a proximity coupling, this offering the advantage of being able to decouple the feed circuits relating to the two frequency bands (transmit/receive) on two different surfaces, thus offering natural isolation between the circuits. However, to obtain dual-band operation, this solution is in practice feasible only for band ratios of greater than 4:1, and not for applications targeting for example a band ratio of the order of 1.25:1 to 2:1.

To summarize, in dual-band antennas, the prior art has sought good decoupling between the two bands, and in order to do this, it has been proposed, as in document [2], that two radiating elements associated with two corresponding reactive coupling layouts be adopted.

For best decoupling of the two frequency bands, clearly distinct dimensions have been adopted for the two radiating elements.

Thus, in document [2], plates of small size are adopted for a first band and a wide plate is adopted for a second band. The small plates are coupled with two feed lines and two slots, and the wide plate is coupled with two other feed lines, that are placed in the direct vicinity of this wide plate. The large plate has a surface area of around 32 times the surface area of each of the small plates.

By way of a big difference in the dimensions of the radiating elements, good decorrelation between the bands has been obtained, but in this case these bands turn out to be far apart and narrow. In other cases it is desirable, conversely, to obtain bands that are wider and closer together, although strongly decoupled.

It is the essential aim of the invention that to propose an antenna having these advantages, that is to say an antenna of small volume, having two well-decoupled bands, the two bands of which may be close together, and at least one of the bands of which may be very wide.

Such an antenna is, according to the invention, a printed antenna comprising two substantially stacked radiating elements of planar form, a first reactive coupling layout able to excite one of the radiating elements, this first reactive coupling layout comprising at least one feed line and one conductive ground plane furnished with at least one coupling slot, the antenna furthermore comprising a second reactive coupling layout able to excite the other of the radiating elements, characterized in that the radiating elements have surface areas whose values are sufficiently similar for the first reactive coupling layout to produce a simultaneous coupling of the two radiating elements.

Beyond a certain threshold of similarity between the two radiating elements, the two operating bands due respectively to the first and second excitation layout are clearly distinguished from one another although they are close, on account of the fact that at least the coupling with the layout comprising the slot is a dual coupling.

Thus, the adoption for a frequency band of a dual coupling with the slot (contrived by making the dimensions of the two radiating elements similar rather than different) associated for the other band with a coupling with a simple element turns out to produce a particularly effective decoupling. The possibility of arranging the feed circuits associated with the two frequency bands on separate layers allows a further improvement in the isolation between bands and facilitates topological setup of these circuits.

Other characteristics, aims and advantages of the invention will become apparent on reading the detailed description which follows, given with reference to the appended figures in which:

FIG. 1*a* is a cross section of a unitary antenna according to a first embodiment of the invention, in which a second feed line 35 is situated between two radiating patches 25 and 45;

FIG. 1*b* corresponds to another embodiment in which the second feed line 35 and situated between a lower radiating patch 25 and a ground plane comprising coupling slots 15;

FIG. 2*a* is a view from above of this same unitary antenna;

FIGS. 2*b* and 2*c* represent two variants of a radiating element, according to the invention;

FIG. 3 is a simplified diagram viewed from above of a reactive coupling layout of this same unitary antenna;

FIGS. 4*a* to 4*c* present results of measurements of transmission and reflection coefficients obtained with the antenna of FIGS. 1 to 3;

Figure 7:
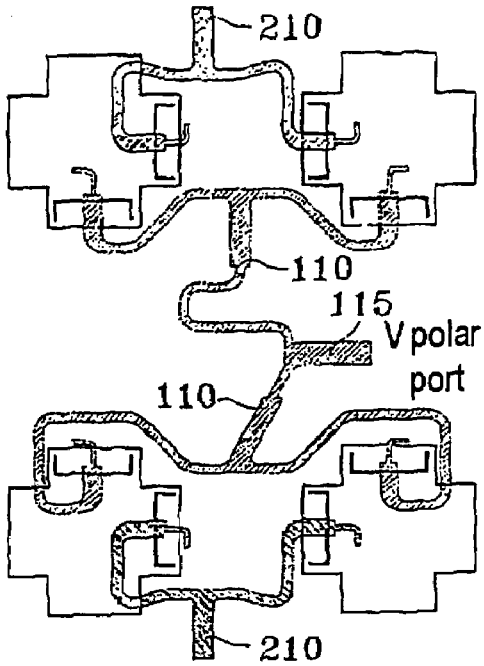
FIG. 7 is a view from above of an assembly comprising two pairs of antennas in accordance with FIG. 6, pairs linked in a manner advantageous for reducing stray coupling currents.
Figure 8A:
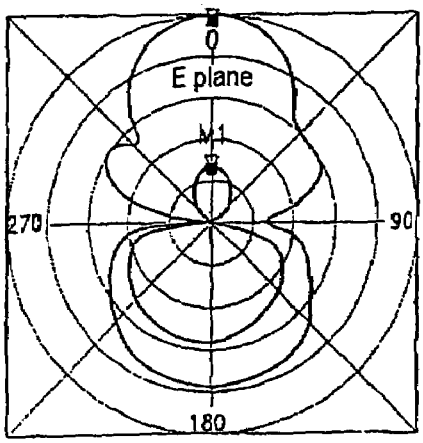
Figure 8B:
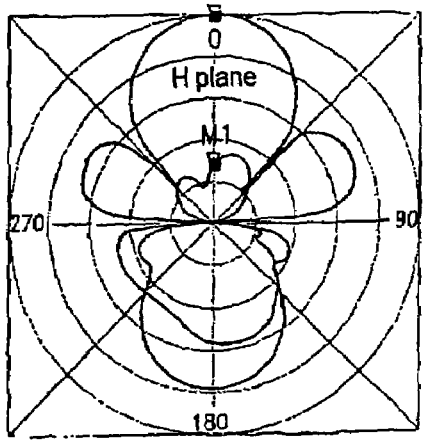
Figure 9:
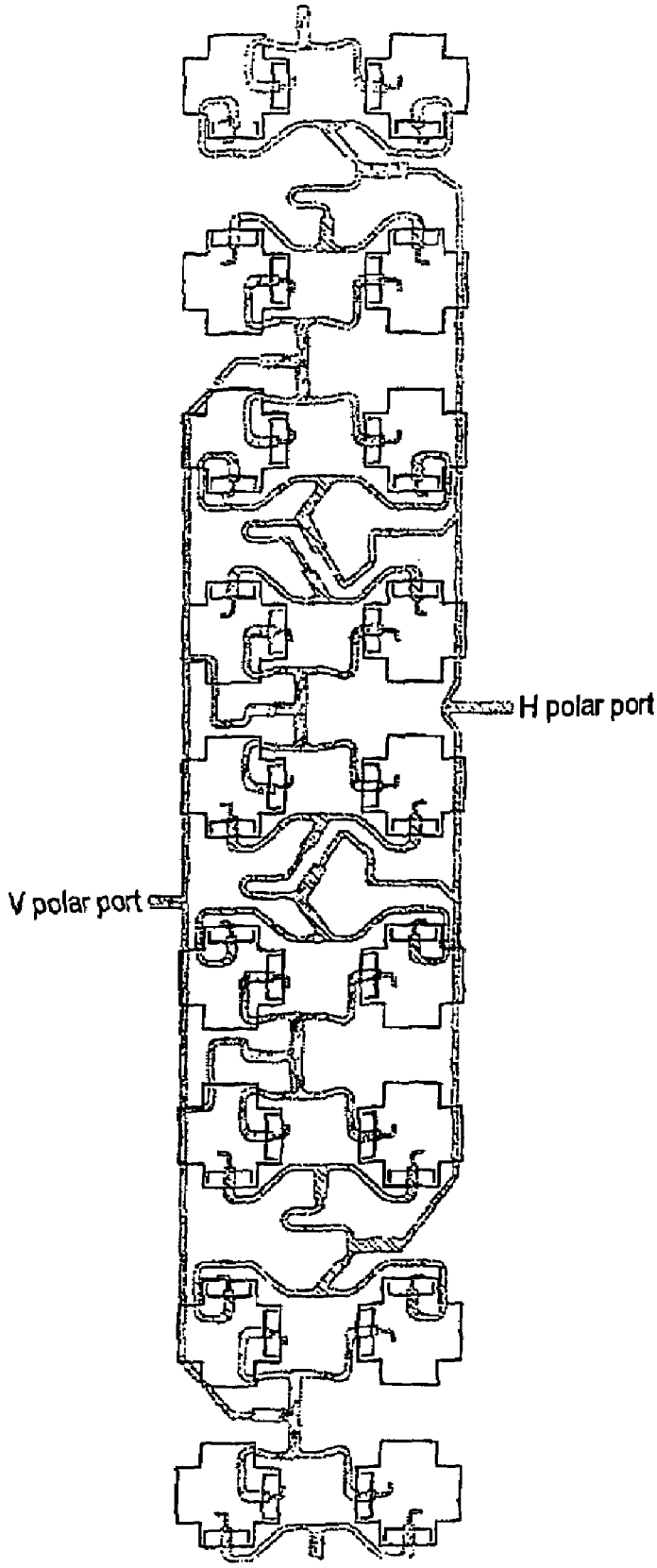

FIGS. 8*a* and 8*b* represent radiation patterns obtained for the array consisting of four unitary antennas in accordance with that of FIG. 7;

FIG. 9 represents an array of unitary antennas fed according to a feed architecture that is advantageous for reducing stray coupling currents.

Figure 1A:
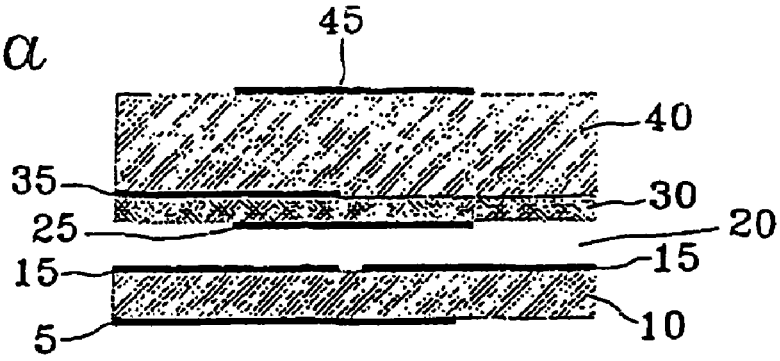
Figure 2A:
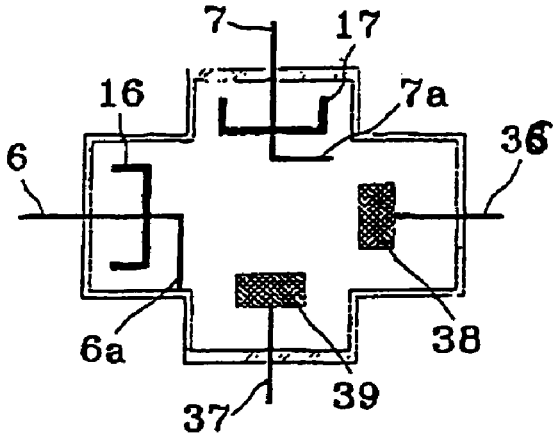
Figure 3:
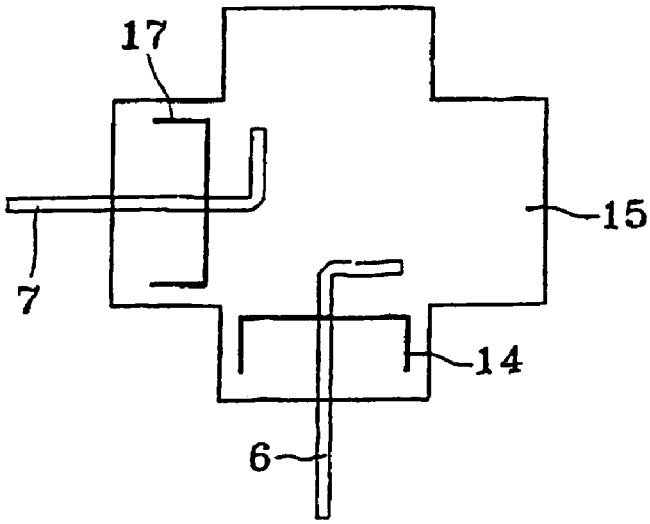
Figure 1B:
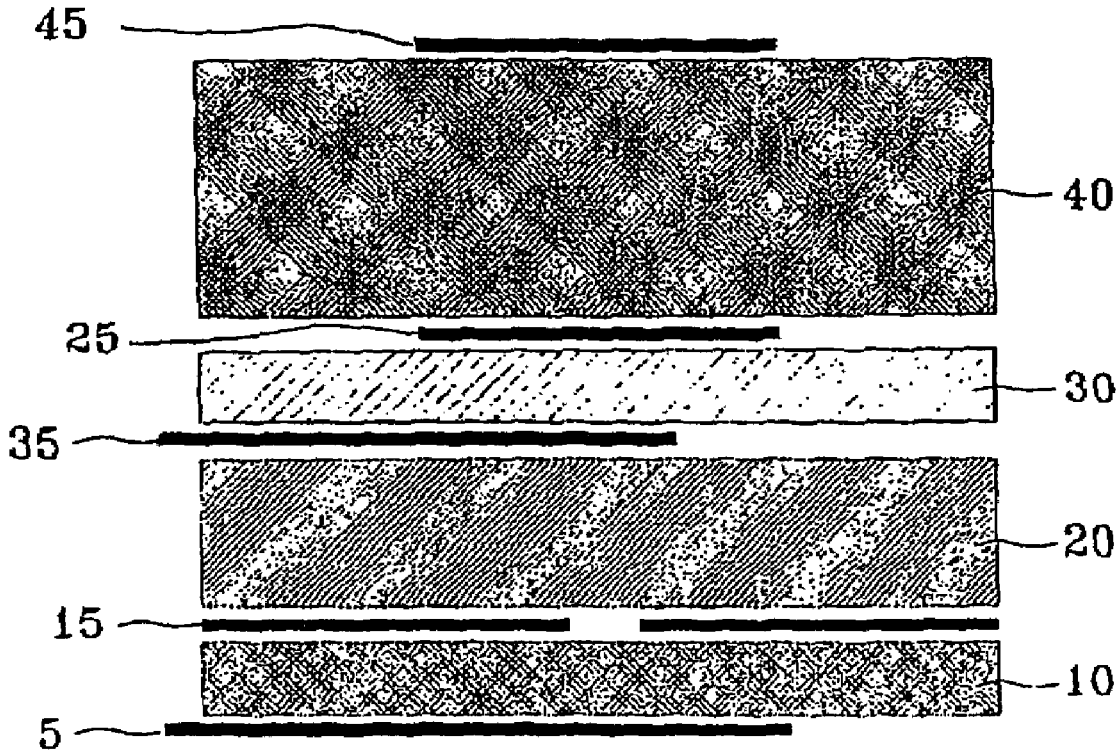

Represented in FIGS. 1 to 3 is a unitary antenna according to a preferred embodiment of the invention.

This unitary antenna consists of four layers of substrate 10, 20, 30, 40, isolating five metallization layers 5, 15, 25, 35 and 45 therebetween.

The increasing direction of these numberings corresponds to a direction of traversal going from the bottom to the top in the vertical section of FIG. 1.

The metallization layers comprise two layers 5 and 45 arranged respectively at the lower face and at the upper face of the antenna, and three layers 15, 25 and 35 which are each arranged between two substrate layers.

Two metallizations 25 and 45 each form a radiating element, and the other three metallizations 5, 15 and 35 enter into the realization of two reactive coupling layouts, that is to say for exciting the radiating elements 25 and 45.

Figure 2C:
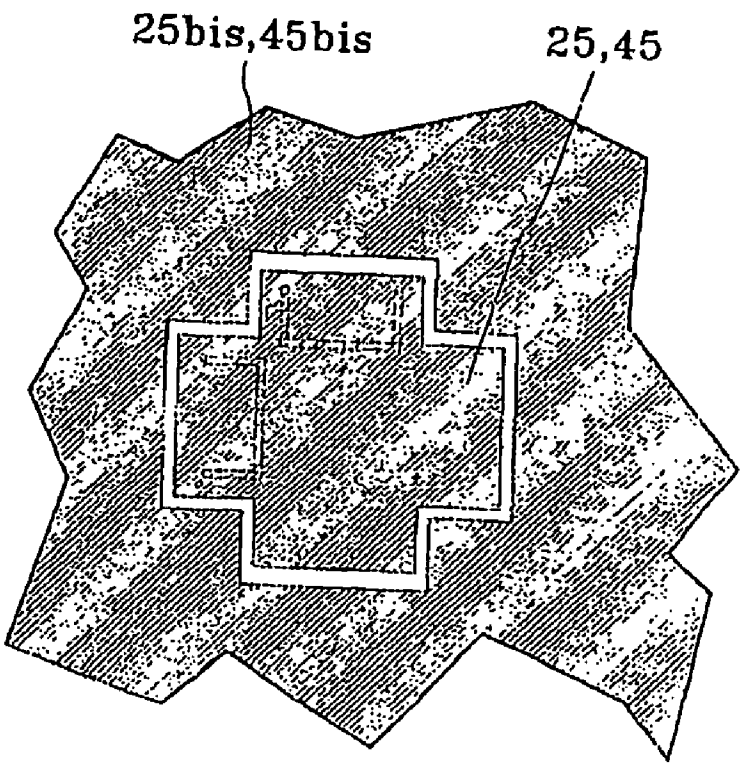
Figure 2B:
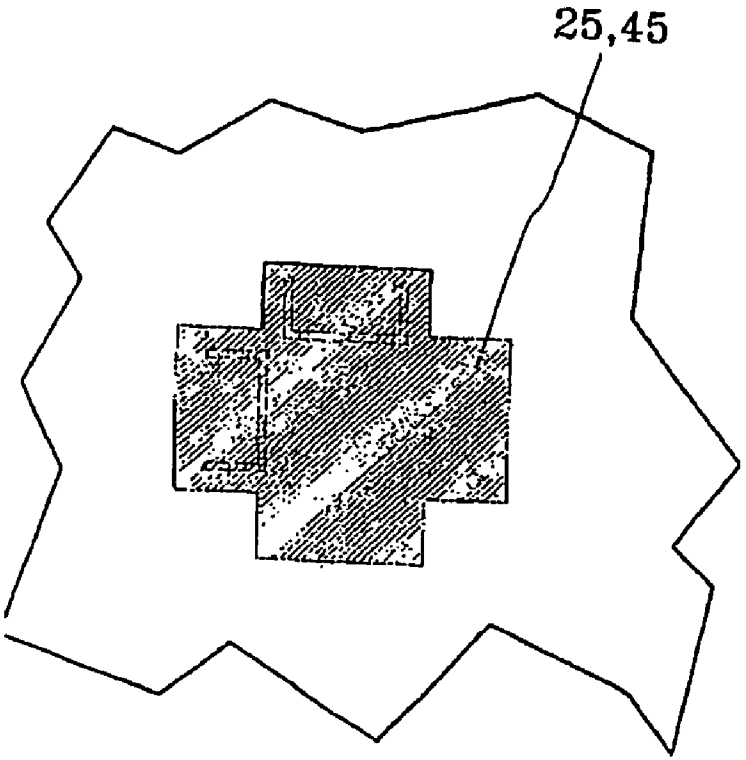

It will be noted that the radiating elements (made of copper for example) may themselves incorporate diverse apertures, that they may be etched on layers furnished or otherwise with a uniplanar ground plane 25bis, 45bis (cf. FIGS. 2*b* and 2*c*). When the layer is furnished with a ground plane, the radiating element 25, 45 is isolated therefrom by a slot which hugs its contour (cf. FIG. 2*c*).

A first of these two reactive coupling layouts includes the lower metallization 5 and the immediately higher metallization 15. The lower metallization 5 forms two feed lines 6 and 7, which here are microstrips, which could be triplate. These feed lines 6 and 7 are fed at a first frequency, which is a low frequency.

The immediately higher metallization 15 is a ground plane perforated with two coupling slots 16 and 17 each placed plumb with and perpendicular to a respective one of the lines 6 and 7.

The coupling slots 16 and 17 are here U-shaped so as to save space. They may be straight or "dog bone" shaped for optimal effectiveness. The feed lines 6 and 7 extend beyond the coupling slots 16 and 17, forming matching stubs 6*a* and 7*a*.

The second reactive coupling layout comprises the metallization 35, which is situated between the radiating elements 25 and 45 or else between the lower radiating elements 25 and the ground plane 15. this metallization 35 forms two feed lines 36 and 37 in the form of microstrips etched on the substrate layer 30, and fed at a second frequency, which here is a high frequency.

The portion of a conducting link which extends in the antenna along the chosen direction of radiation is called a "feed line". Stated otherwise, this is the part which is principally active electromagnetically in a conducting line.

It will be supposed hereinbelow by convention that the frequency band associated with the excitation by the slots 16 and 17 is called the "reception band", and that the frequency band associated with the excitation by the lines 36 and 37 situated above the ground plane 15 is called the "transmission band".

However, the terms "transmission" and "reception", used here for clarity of account, may in practice not correspond to usage of the relevant band for such "transmission" or such "reception", any swapping or combining of the transmission and reception functions in the various bands being envisaged within the framework of the invention. This remark is true for all of the subsequent description, including for the part of the account hereinbelow pertaining to array arrangements.

The manner of operation of the antenna in the band dubbed "reception" relies on the simultaneously reactive coupling of the two radiating elements 25 and 45, or dual coupling.

This dual coupling is obtained by the fact that the radiating elements 25 and 45 are envisaged as having mutually similar surfaces, that is to say surface areas having a relative discrepancy of less than about 20%. The difference in surface area divided for the mean surface area of the two surfaces is called the relative discrepancy in surface area.

Each of the two elements 25 and 45 radiates in the reception band. Moreover, each element 25 and 45 being excited by two perpendicular feed lines 6 and 7, each radiates two fields polarized in two mutually perpendicular directions.

In the band dubbed "transmission", the feed lines 36 and 37 generate a proximity reactive coupling on the upper radiating element 45.

Specifically, they excite principally the upper radiating element 45, the lower radiating element 25 behaving, for its part, in the manner of a ground plane. The excitation generated by the excitation layout 36, 37 may however, according to a variant, consist also of a simultaneous reactive coupling on the two radiating elements 25 and 45 (dual coupling).

The feed lines 36 and 37 correspond to respective radiations in two perpendicular directions.

It will be noted that the feed lines 6, 7, 36, 37 are maximally separated from one another. In particular, a ground plane is interposed between the lines 6, 7 and the lines 36, 37 so as to increase their isolation. Moreover, advantageously, two polarizations have been devised on each of the layers 5 and 35 (hence a total of four ports) while by contrast having specific frequency bands Tx or Rx for each layer.

In the present preferred embodiment, the two feed lines 36 and 37 are preferably placed in such a way as to be closer to the radiating element 25 than to the radiating element 45.

The proximity coupling generated by the lines 36 and 37 is here a capacitive coupling, but may also be inductive (self inductance).

The proximity coupling is optimized by the fact that the feed lines 36 and 37 are furnished at their end which is inside the antenna with capacitive terminations 38 and 39, here in the form of rectangular plates.

Such terminations make it possible, through the choice of their size, to predetermine the amount of coupling.

The plate-shaped terminations may be replaced by terminations consisting of slots made inside the antenna in the radiating element 25, in particular in a variant where the substrate layer 30 is dispensed with and where the feed lines 36 and 37 run directly onto the radiating element 25 thus perforated, or else when the layers 30 and 35 are situated under the layer 25. Such slots turn out to behave likewise as feed lines, and generate an inductive or capacitive coupling depending on their length.

Terminations which are inside the antenna are advantageously adopted since they then generate no bulk outside the unitary antenna, this being particularly important in the planar arrays of such antennas, which have to be compact.

In the present embodiment, the radiating elements 25 and 45 are squares 10 mm wide, and the antenna has a total thickness of the order of 2 mm.

It will be noted that the dielectric properties, customarily denoted $\in$, $\mu$, of the various substrate layers may be chosen to be different depending on the layers.

Each of the feed lines 6, 7, 36, 37 is fed by way of a local link, called a port.

Each of the four lines of a given antenna is fed with an independent signal, originating from a different port out of four ports linked to the antenna. The antenna described here, which is dual-polarized and dual-band, is therefore in fact an antenna with four ports.

The ports and the feed circuits associated with the reception band are etched totally on the substrate layer 10 situated under the ground plane 15 of the antenna. This arrangement provides natural spatial isolation with regard to the substrate layer 30 situated above the ground plane 5 which carries the feed circuits of the transmit layer. This architecture provides typical isolation between the transmit ports and the receive ports of the order of −30 to −40 dB.

In order to improve the quality of polarization of the radiated fields, polarizing grids may replace the solid metallizations which here constitute the radiating elements.

Here, cross shapes have been chosen for the radiating elements 25 and 45, which optimize the radiation, but square, rectangular or circular shapes may also be adopted, which possibly incorporate slots or apertures.

These elements may be etched on layers furnished or otherwise with the uniplanar ground plane (cf. FIGS. 2*b* and 2*c*). In the latter case (FIG. 2*c*) the radiating element is isolated from the ground plane by a slot which hugs its contour.

The antenna exhibits a reception band which is particularly wide and which is particularly well decoupled from the transmit band.

This receive band exhibits a spread of at least 15%, preferably of at least 20%, and here of 18%, numbers obtained by virtue of the dual coupling of the radiating elements in this band. The ratio of the width of the band to the center frequency of the band is called the bandwidth or spread.

More precisely, here the receive band is 10.75–12.75 GHz for an SWR (Standard Wave Ratio) of less than 1.8.

Figure 4A:
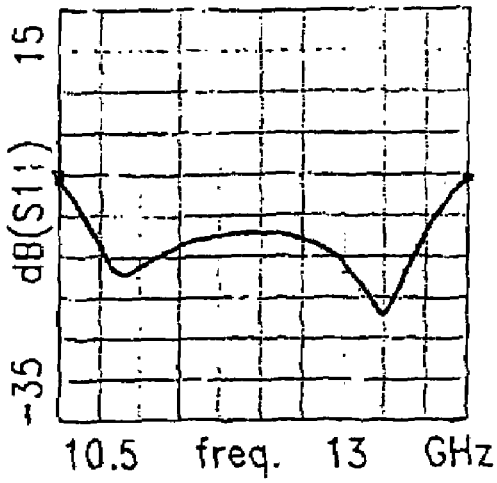
Figure 4B:
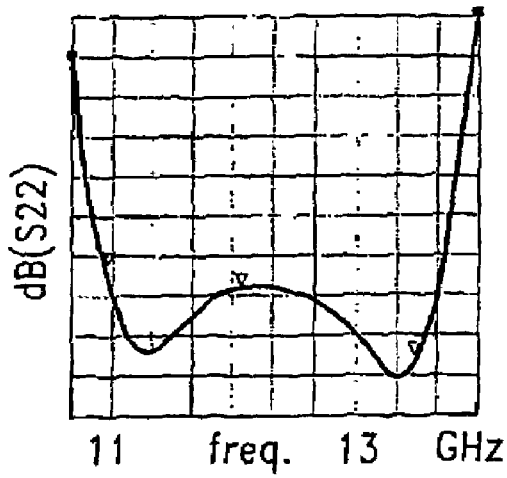
Figure 4C:
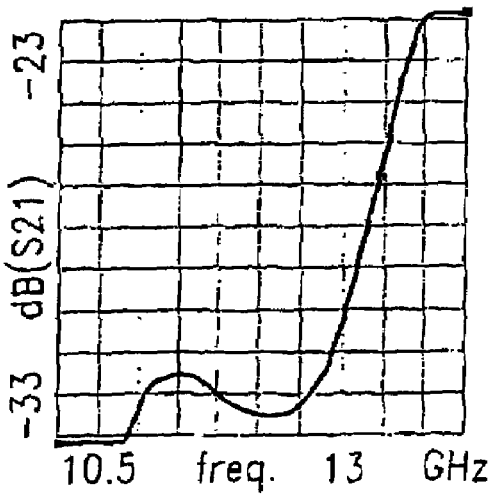
Figure 5:
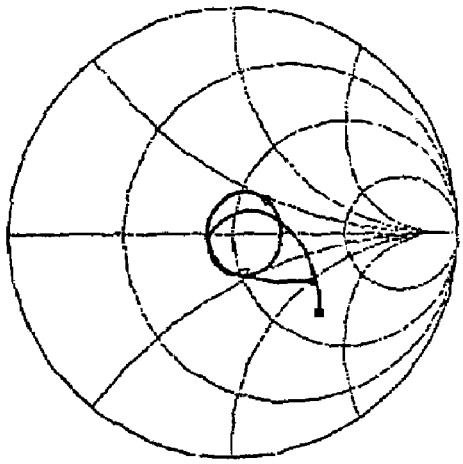
FIG. 5 is a Smith representation corresponding to the antenna of FIGS. 1 to 3.

FIGS. 4*a* and 4*b* present the profiles of reflection coefficients S11 and S22, and FIG. 5 is a Smith representation for the parameter S11. These figures suggest a passband of considerable width (here of the order of 20%). As may be seen the isolation between the ports, as represented by the profile of the parameters of FIG. 4*c* (parameters S12 or S21), is better than 20 dB.

The preferred antenna described here is therefore dual-polarization and dual-band (hence 4 ports), with the advantages of traditional printed antennas (bulk, weight) with enhanced performance in terms of bands and in terms of isolation between the two bands.

The antenna just described will advantageously constitute the unitary element of an array including several antennas such as this one, for example several thousand such antennas.

A feed layout of such an array, which has the advantage of reducing the stray currents due to couplings between perpendicular feed lines of the antennas, will now be described.

Such a layout, while it produces a synergy with the advantages of the unitary antennas described above, turns out also to retain its advantage in terms of elimination of stray currents in the case of other antenna arrays, in particular for antennas having two polarizations.

Figure 6:
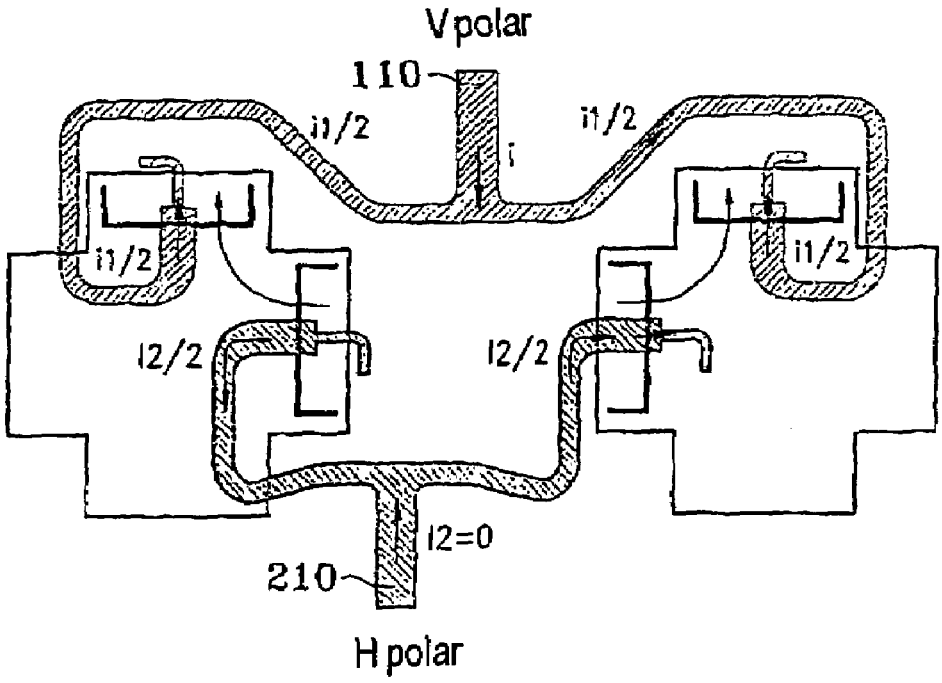
FIG. 6 is a view from above of a pair of unitary antennas fed according to an electrical diagram that is advantageous for reducing stray coupling currents.

The preferred feed layout, as now described, is formed of two circuits and is based on a series of pairs of antennas similar to the pair of FIG. 6.

Each antenna exhibits at least two perpendicular feed lines.

The feed lines of FIG. 6 are those of the so-called receive band, but the arrangements described are also adopted for the feed layout of the transmit band.

Each antenna of FIG. 6 exhibits two perpendicular directions of radiation, here called the H (horizontal) direction and the V (vertical) direction.

A first link connecting the antenna pair to the remainder of the array, called the first port and referenced 110, feeds the two feed lines of direction V in the two antennas. A second link, called the port 210, feeds the feed lines H of the two antennas.

The objective of the feed layout described below is that the currents conveyed by a port corresponding to one feed direction should not give rise to a stray current in a port corresponding to the other feed direction, which stray current would be due to coupling within each antenna between the H and V directions.

With this aim, each port separates toward the two antennas into two branches, which branches are arranged in such a way as to do away with the stray currents.

Thus, in FIG. 6, the two branches emanating from the port 110 exhibit at the end thereof, when they are traversed in the direction going from the port to the end of the relevant branch, each time one and the same sense directed outward from the antenna.

On the other hand, when traversing the two branches emanating from the port 210, these branches exhibit at the end thereof, in their portion having the direction H, that is to say at the level of their part called the "feed line", an outgoing sense that is directed toward the outside of the antenna in the case of one of the branches, and a reentrant sense directed toward the inside of the antenna in the case of the other branch.

Thus, a first port splits into branches with the same direction of feed V and with the same outgoing sense, and the second port splits into branches with the same feed direction H but of opposite sense out of the entrant and outgoing senses.

Through such an arrangement, a current in one of the two ports produces almost no stray current in the other of the two ports, despite the couplings between perpendicular feed lines in each of the two antennas.

Supposing, by convention, that a current i1 arrives at the port 110 (V port) heading for the antennas, the current i1 separates into two substantially equal currents (current divider) i1/2 in the two branches emanating from the port, which current i1/2 flows at the level of the feed lines with direction V in the antennas, in two like outgoing senses for the two antennas. Each of the V-polar elements is then fed at equiamplitude and equiphase.

Currents are engendered in the H branches by coupling, due to the presence of currents in the V branches. These coupling currents are principally due to the fact that the unitary antenna is not perfectly symmetric, on account of the arrangement of the slots.

The branches emanating from the H port have, for their part, two different senses when traversed from the port, one reentrant and the other outgoing from the relevant antenna. Therefore, the currents generated in these two branches due to the presence of the currents i1/2 in the V branches are currents which are reverse. In a first H branch, a current i2/2 directed toward the port is generated, whereas in the second branch, a current i2/2 traveling away from the port is generated.

The two currents i2/2 having a port/antenna sense in the case of one and an antenna/port sense in the case of the other, only a difference between the moduli of these two currents could enter the port 210 (H port).

These currents arriving in phase opposition at the divider formed by the port 210, only a difference in modulus could enter the port. These currents i2/2 do not therefore worsen the decoupling between the H and V polarizations.

In the present case, the two antennas are of like structure and the two branches of each port are similar.

Thus, the current i1 separates cleanly into two equal currents. The coupling is very similar in both antennas. Stated otherwise, a stray coupling is created, identical in modulus on account of symmetry. The stray currents i2/2 in the two branches of the port 210 (H port) therefore have very similar magnitudes and the subtraction of these two currents does indeed give a substantially zero stray current in the port 210 (H port).

Of course, the reverse couplings, namely due to a current in the H branches and generating stray currents in the V branches, exhibit attenuated effects in the same manner due to a cancellation between stray currents at the level of the V port.

The basic arrangement of FIG. 6 makes it possible to improve decoupling, which was already 20 dB in the unitary antenna alone. In practice, isolation between the ports 110 and 210 of the order of −40 dB has been observed. This arrangement also brings about a consequent improvement in the cross polarization performance as may be observed in the E-plane and H-plane sections through the polarization patterns presented in FIGS. 8*a* and 8*b*, with a maximum cross polarization on the axis of the order of −38 dB.

This topology based on dual elements is particularly adapted to the production of large-size arrays. As illustrated in FIG. 9, where antenna pairs fed in this way are advantageously multiplied.

In the array represented, the H feed lines of the antennas are fed through a first circuit, and the V feed lines are fed through a second circuit.

Each of these two circuits is a tree consisting of cascaded splittings, up to terminal branches linked in pairs to two antennas according to a feed diagram similar to that of FIG. 6.

The array of antennas of FIG. 9 thus exhibits two ports which each form a root of the tree concerned. The terminal branches are preferably situated at one and the same tree level relative to their respective root so that the symmetries are indeed complied with.

As represented in FIG. 7, the terminal ports 110 are linked to upper ports 115 in such a way that any residual stray currents in the terminal ports 110 subtract once again at the level of the upper ports 115.

Thus, for the V polarization feed tree, these ports 115 of immediately higher level group together pairs of terminal ports that extend, each time, in the one case as incoming branches and in the other case as outgoing branches.

With the arrangements described hereinabove, feed circuits are obtained for a column of antenna pairs, which columns lend themselves particularly well to integration within limited spaces.

These tree-like feed circuits described here for the layer of the receive band preferably apply also to the layer of the transmit band.

A technology of CMS (Surface Mounted Components) type allows transference of active elements, which is very advantageous in terms of cost, which here may be applied separately onto each of the transmit and receive layers, allowing good isolation to be preserved naturally between the various circuits and facilitating control of the ohmic losses if for example one active circuit is implanted per column of unitary antennas.

For the person skilled in the art, it will be easy to adapt the whole of this architecture so as to obtain operation under circular polarization by adding, for example, an element of coupler or hybrid ring type between the horizontal polarization (H) and vertical polarization (V) ports of the array described above.

The unitary antenna described in the first part of the description lends itself perfectly moreover to integration on low loss foam substrates and may be associated, for the transference of the active elements, with the CMS (Surface Mounted Components) technological discipline, this being very advantageous in terms of cost and constituting an additional synergy between the unitary antenna proposed hereinabove and the feed circuits proposed here.

[1] MACI S., Biffi Gentili G. "Dual Frequency Patch Antennas" *IEEE AP Magazine,* vol. 39, No. 6, December 1997, pp. 13–19

[2] Targonski, S. D., Pozar D. M. "Dual Band dual polarized printed antenna element" *Electronic Letters,* vol. 34, No. 23, November 1998, pp. 2193–2194

[3] Zurcher J. F. et al. "A computer dual port, dual frequency, printed antenna with high decoupling" *Microwave and optical technological letters,* vol. 19, No. 2, October 1998, pp. 131–137

[4] P. Brachat, R. Béhé, G. Kossiavas, L. Habib, A. Papiernik Antennes microrubans polarisés par des grilles

[Microstrip antennas polarized by grids] *Annales des Télécommunications,* volume 48, No. 11–12, 1993, pp. 567–572

[5] P. Brachat, R. Behe Antenne imprimée pour réseau à double polarisation [Printed antenna for dual-polarization array] Patent No. 9013563—October 1990

The invention claimed is:

1. A printed antenna comprising two substantially stacked radiating elements (25, 45) of planar form, a first reactive coupling layout (5, 15) able to excite one of the radiating elements (25, 45), this first reactive coupling layout comprising at least one feed line (6, 7) and one conductive ground plane (15) furnished with at least one coupling slot (16, 17), the antenna furthermore comprising a second reactive coupling layout (25, 35) able to excite the other of the radiating elements, characterized in that the two radiating elements (25, 45) have surface areas whose values are sufficiently similar for exhibiting a relative discrepancy of their surface areas which is less than 20% so that the first reactive coupling layout produces a simultaneous coupling of the two radiating elements (25, 45), wherein at least one of the two radiating elements (25, 45) is etched on a layer comprising a uniplanar ground plane, said radiating element isolated from said ground plane by a slot hugging its contour.

2. A printed antenna comprising two substantially stacked radiating elements (25, 45) of planar form, a first reactive coupling layout (5, 15) able to excite one of the radiating elements (25, 45), this first reactive coupling layout comprising at least one feed line (6, 7) and one conductive ground plane (15) furnished with at least one coupling slot (16, 17), the antenna furthermore comprising a second reactive coupling layout (25, 35) able to excite the other of the radiating elements, wherein the two radiating elements (25, 45) have surface areas whose values are sufficiently similar for exhibiting a relative discrepancy of their surface areas which is less than 20% so that the first reactive coupling layout produces a simultaneous coupling of the two radiating elements (25, 45) and wherein said two radiating elements (25, 45) are vertically aligned.

3. The antenna as claimed in claim 1 or claim 2, wherein the antenna exhibits an operating frequency band corresponding to the dual coupling of the radiating elements (25, 45), which has a relative width of greater than 15%.

4. The antenna as claimed in claim 1 or claim 2, wherein the second reactive coupling layout (35) includes at least one feed line (36, 37).

5. The antenna as claimed in claim 4, wherein the feed line(s) (36, 37) of the second reactive coupling layout (35) extends (extend) between the two radiating elements.

6. The antenna as claimed in claim 5, further comprising, among the two radiating elements (25, 45), an element (25) closest to the ground plane (15), and in that the feed line (36, 37) of the second reactive coupling layout (25, 35) is closer to this radiating element (25) than to the other radiating element (45).

7. The antenna as claimed in claim 1 or claim 2, further comprising, among the two radiating elements (25, 45), an element (25) closest to the ground plane (15) and in that the second reactive coupling layout (35) extends between the radiating element (25) closest to the ground plane (15) and the ground plane (15).

8. The antenna as claimed in claim 1 or claim 2, wherein the first reactive coupling layout (5, 15) comprises two feed lines (6, 7) extending in mutually perpendicular directions in the antenna, and in that the ground plane (15) comprises two slots (16, 17) extending in two mutually perpendicular principal directions, these two slots (16, 17) each being arranged plumb with a corresponding feed line (6, 7) of the first reactive coupling layout and perpendicular to this corresponding feed line (6, 7).

9. The antenna as claimed in claim 1 or claim 2, wherein at least one of the reactive couplings layouts (5, 15, 25, 35) of the antenna comprises two feed lines (6, 7, 36, 37) extending in the antenna in mutually different directions.

10. An array comprising at least one pair of antennas each in accordance with claim 9, and two electrical ports (110, 210) from which there extends on each occasion a pair of branches, each branch of a first port (110, 210) linking a first respective feed line in each of the two antennas, and each branch of a second port (110, 210) linking a second respective feed line in each of the two antennas, the branches of the first and of the second ports (110, 210) being arranged in such a way that a current (ii, i2) arriving at one of the ports in the direction of the antennas separates into currents in the branches of this port which by coupling produce two stray currents in the branches of the other port, which stray currents have senses among the antenna/port and port/antenna senses that are opposite according to the branches of this other port.

11. The array as claimed in claim 10, wherein the branches of a first port (110) are arranged in such a way that a current arriving at this first port (110) toward the antennas separates into two currents that traverse the two corresponding feed lines on each occasion in one and the same sense from among a sense directed toward the inside or a sense directed toward the outside of the antenna, and the branches of the second port (210) are arranged in such a way that a current arriving at this second port (210) in the direction of the antennas separates into two currents that traverse the corresponding feed lines, one toward the inside of the antenna and the other toward the outside of the antenna.

12. An array comprising at least two pairs of antennas, each pair of which forms an array in accordance with claim 11, and in which said first port (110) of a pair of antennas exhibits branches arranged in such a way that a current arriving from the port in a feed line exhibits one and the same sense in both feed lines, directed toward the inside of the antennas, and said first port (110) of the other pair of antennas exhibits branches arranged in such a way that a current arriving from the port in a feed line exhibits one and the same sense in both feed lines, directed toward the outside of the antennas, these two first ports (110), having reentrant feed lines in the case of one and having outgoing feed lines in the case of the other, being linked to one and the same upper port (115).

13. An array of antennas comprising a series of antenna pairs, and comprising two circuits each forming a tree having a series of separations having two branches in cascade, each tree terminating in terminal branches, and in which array each antenna pair forms, together with two pairs of terminal branches belonging to the two trees respectively, a subarray having two antennas in accordance with claim 11.

* * * * *